United States Patent [19]

Ballone et al.

[11] Patent Number: 4,488,460

[45] Date of Patent: Dec. 18, 1984

[54] ERGONOMIC HANDLE FOR HAND TOOL

[75] Inventors: Michael P. Ballone, New Providence; Edward H. Meisner, Short Hills, both of N.J.

[73] Assignee: EASCO Corporation, Baltimore, Md.

[21] Appl. No.: 402,763

[22] Filed: Jul. 28, 1982

[51] Int. Cl.[3] ..... B25B 13/46; B25G 1/00

[52] U.S. Cl. ..... 81/60; 81/177 R; 81/177 B; 145/61 R; 145/75; D8/25

[58] Field of Search ..... 16/DIG. 18, DIG. 19, 16/DIG. 40, DIG. 41, DIG. 24, 110 R, 121; 145/75, 76, 61 R, 61 E, 61 EA, 61 C, 61 L; 173/163; 7/167; 81/177 R, 177 B, 177 G, 60–63.3; 74/543; D8/107, 300, DIG. 2, DIG. 7, 21, 25; 135/65

[56] References Cited

U.S. PATENT DOCUMENTS

| | | | |
|---|---|---|---|
| 176,811 | 5/1876 | Richards | 145/75 |
| 347,054 | 8/1886 | Morse | 145/61 C X |
| 666,512 | 1/1901 | Furbish | 145/75 |
| 1,980,087 | 11/1934 | Rast | 145/61 C |
| 2,720,296 | 10/1955 | Briglia | 145/75 X |
| 3,080,900 | 3/1963 | Rosenberg | 81/177 R X |
| 3,824,881 | 7/1974 | Wright | 81/177 G X |
| 3,893,205 | 7/1975 | Anderson et al. | 16/121 |
| 3,908,487 | 9/1975 | Plaw | 145/76 X |
| 4,090,298 | 5/1978 | Rushforth | 145/61 C X |

*Primary Examiner*—Frederick R. Schmidt
*Assistant Examiner*—Debra S. Meislin
*Attorney, Agent, or Firm*—Leonard Bloom

[57] ABSTRACT

An improved ergonomic handle for a hand tool or other implement has a substantially elliptical cross-section taken in a first plane which forms a dihedral angle of approximately thirty (30) degrees with respect to a second plane which is normal to the longitudinal axis of the shank of the tool. The length of the minor axis of the elliptical cross-section is approximately sixty percent (60%) of the length of the major axis. The longitudinal axis of the shank passes through the elliptical cross-section and through the line formed by the intersection of the first and second planes. The handle is formed substantially as a revolution of the elliptical cross-section about its major axis. As a result, the handle is well balanced and accommodates a variety of hand grips for various uses or orientations of the tool, and the handle is convenient and comfortable for substantially reducing operator fatigue over extended use of the tool. This is especially advantageous in connection with a hand ratchet tool.

3 Claims, 12 Drawing Figures

ERGONOMIC HANDLE FOR HAND TOOL

FIELD OF THE INVENTION

The present invention relates to an improved handle for a hand tool or other hand-held implement, and more particularly, to an ergonomic handle which facilitates convenient and comfortable use of a hand ratchet tool over extended periods of time.

BACKGROUND OF THE INVENTION

Handles for hand tools and various implements are quite old and highly developed in the prior art. The handles for most hand tools are generally cylindrically shaped and are longitudinally fluted in the case of screwdrivers, or knurled in the case of ratchet wrenches, to facilitates a good grip on the tool. If the tool is used only occasionally, the handles are generally satisfactory for the purposes intended. However, if the tool is used for an extended period of time, the handle can become uncomfortable, leading to blisters or callouses on the operator's hand. This is significant not only for the professional mechanic or tradesman, but also for the home owner, hobbyist and do-it-yourselfer. The latter, because of either necessity or desire, are spending an increasing amount of time using hand tools for car maintenance, general repair purposes and other projects around the home.

In an apparent attempt to improve operator comfort and simultaneously amplify the degree of leverage that may be applied to the tool by the user, the prior art has resorted to various knob-shaped handles and pistol-grip handles for certain tools. While these tools may be suitable for the purposes intended, the degree of operator comfort and convenience has not been maximized, nor perfected, for extended use of the tool. This is especially pertinent with respect to hand ratchet tools.

Additionally, the prior art has disclosed an assortment of odd-shaped handles, which are intended for certain specific purposes. These handles are generally gripped by the operator in the same manner regardless of the particular orientation of the tool in relation to the work being performed. To the best of our knowledge and belief, the hand tools and implements (with which these various odd-shaped handles are associated) are generally impractical or have not been commercialized to any appreciable degree. Moreover, these handles are not readily adaptable to a hand ratchet tool.

SUMMARY OF THE INVENTION

Accordingly, it is an object of the present invention to provide an improved ergonomic handle for use with a wide range of hand tools, adapters and implements, and especially of the ratchet type.

It is another object of the present invention to provide an improved ergonomic handle which is convenient and comfortable to grip over extended periods of use of the tool, thereby substantially reducing operator fatigue.

It is yet another object of the present invention to provide an improved ergonomic handle for a hand ratchet tool, wherein, as the orientation of the tool in relation to the work is varied, the operator's grip on the handle of the tool may be varied accordingly, thereby adapting the tool to the most comfortable grip and efficient wrist action applied by the particular operator.

It is a further object of the present invention to provide an improved ergonomic handle which is aesthetically appealing, yet can be standardized and produced economically for use with a broad line of hand tools, especially of the ratchet type.

In accordance with the teachings of the present invention, an improved handle is provided for the shank means of a hand tool or other hand-held implement. The handle has a substantially elliptical cross-section taken in a first plane passing through the center of the body and inclined with respect to the axis of the shank means. This first plane forms an acute dihedral angle with respect to a second plane which is normal to the axis of the shank means. As a result, a comfortable hand grip is provided for a variety of uses or orientations of the hand tool, and operator fatigue is substantially reduced over extended use of the tool.

In accordance with the further teachings of the present invention, the dihedral angle is approximately thirty (30) degrees. The length of the minor axis of the elliptical cross-section is approximately sixty percent (60%) of the length of its major axis. The longitudinal axis of the shank passes through the center of the handle and through the line formed by the intersection of the first and second planes. The handle is formed substantially as a revolution of the elliptical cross-section about its major axis. The handle is connected to the shank means through a suitable ratchet mechanism for a conjoint turning movement about the shank axis. Preferably, the handle is molded from a suitable plastic material and has a substantially smooth external surface.

These and other objects of the present invention will become apparent from a reading of the following specification taken in conjunction with the enclosed drawings.

DESCRIPTION OF THE PREFERRED EMBODIMENT

Figure 1:
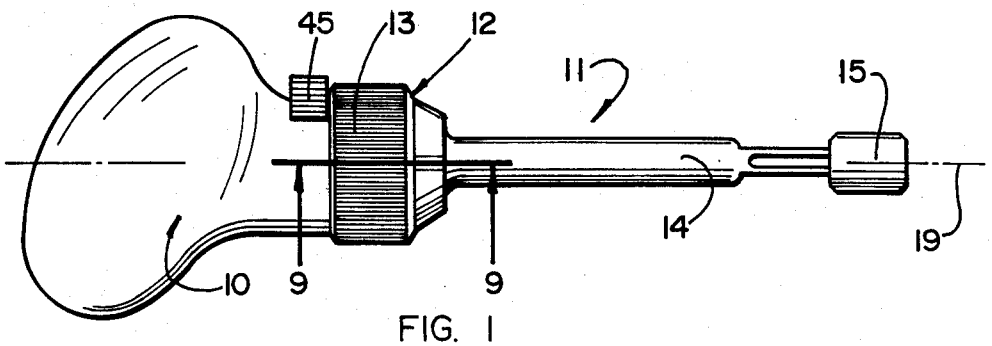
FIG. 1 is a side elevation of a typical hand tool, in this case a ratchet wrench, incorporating the preferred embodiment of the improved ergonomic handle of the present invention.

With reference to FIG. 1, there is illustrated a preferred embodiment of the improved ergonomic handle 10 of the present invention, the handle being applied to a hand ratchet wrench 11. It will be appreciated, however, that the invention is not necessarily restricted to the particular ratchet wrench 11, but rather is equally applicable to a wide variety of hand tools and other hand-held implements and devices. With this in mind, the ratchet wrench 11 generally comprises a ratchet mechanism 12 coupled to the handle and including a knurled spinner 13, an elongated shank 14 coupled to the ratchet mechanism and handle for conjoint turning movement about the axis of the shank, and a socket 15 (or other adapter) carried on the end of the shank.

Figure 2:
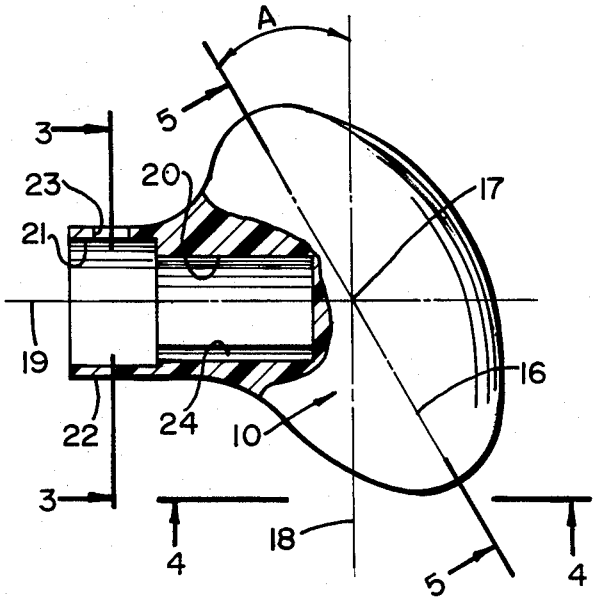
FIG. 2 is a side elevation of the handle of FIG. 1, oriented in an opposite direction and drawn to an enlarged scale, and with a portion thereof broken away and sectioned.
Figure 3:
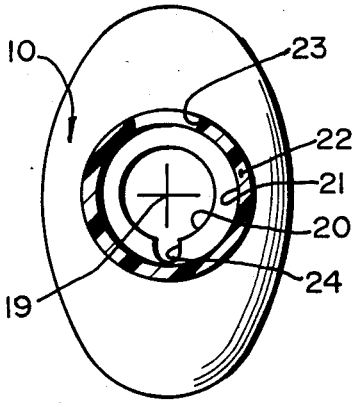
FIG. 3 is a section view of the handle, taken along the lines 3—3 of FIG. 2.
Figure 4:
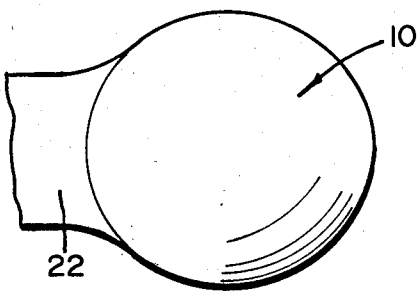
FIG. 4 is a fragmentary bottom plan view of the handle, taken along the lines 4—4 of FIG. 2.
Figure 5:
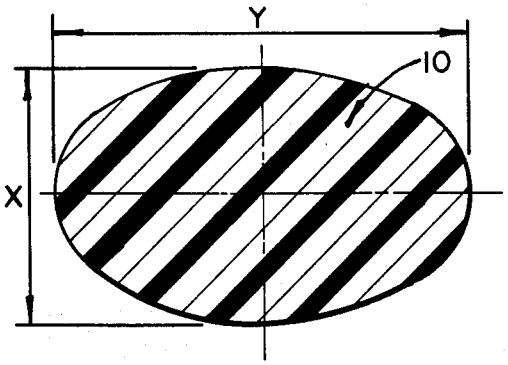
FIG. 5 is a section view, taken along the lines 5—5 of FIG. 2, showing the substantially elliptical cross-section of the handle.

With reference to FIGS. 2–5, the improved ergonomic handle 10 has a substantially elliptical cross-section taken in a first plane 16 passing through its center 17. As shown in FIG. 2, this plane 16 is inclined at an acute dihedral angle A with respect to a second plane 18 which is normal to the longitudinal axis 19 of the shank. Angle A is approximately thirty (30) degrees in the preferred embodiment. The shank axis 19 passes through the center 17 of the handle and through the line formed by the intersection of the first and second planes, 16 and 18, respectively. As shown in FIG. 5, the length of the minor axis X of the elliptical cross-section is approximately sixty percent (60%) of the length of the major axis Y (in the preferred embodiment). The handle is formed substantially as a surface of revolution of the elliptical cross-section about its major axis. Although elliptically-shaped and inclined, the handle is well balanced.

The outer surface of the handle is substantially smooth, but if desired, the surface could be roughened slightly using a well-known sandblasting process to provide a matte finish. The handle is preferably molded from a suitable plastic material. In the area of its elliptical cross-section (in the plane 16, as shown in FIGS. 2 and 5) the handle is substantially solid. However, the handle is provided with a bore 20 formed therein and a communicating counterbore 21, the latter extending into a neck portion 22 of the handle. This neck portion 22 has an arcuate slot 23 formed therein, and the bore has a longitudinal keyway 24. The purpose of the arcuate slot 23 and longitudinal keyway 24 will be hereinafter described.

Figure 6:
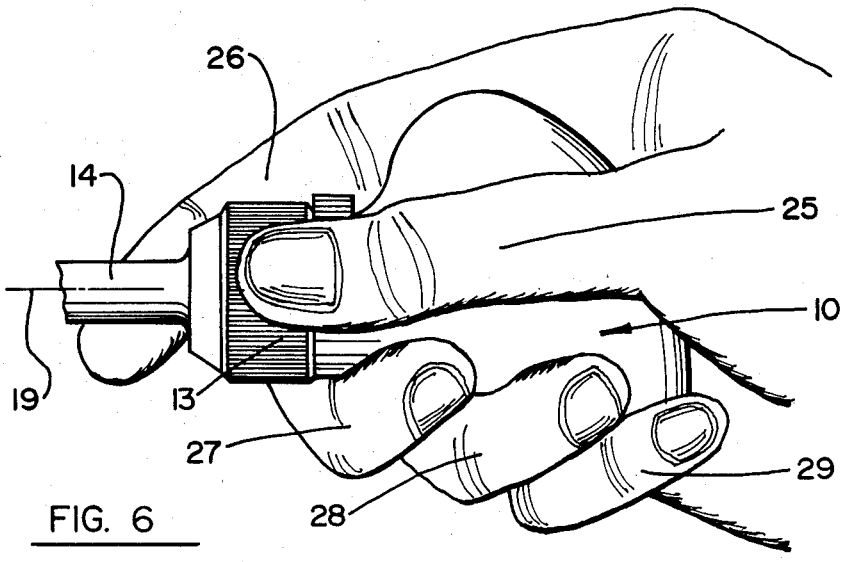
FIG. 6 illustrates a typical orientation of the thumb and fingers of the operator's hand on the improved ergonomic handle, the tool in this case being held at a substantially horizontal direction when applied to the work.
Figure 7:
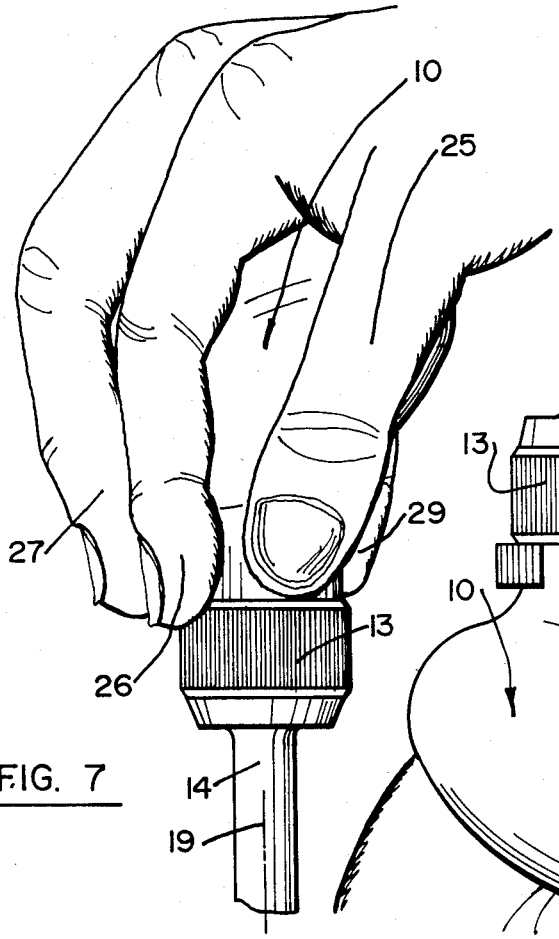
FIG. 7 illustrates a typical (and alternate) orientation of the operator's hand on the improved handle, the tool in this case being held vertically and the operator's bias force being applied down on the work.
Figure 8:
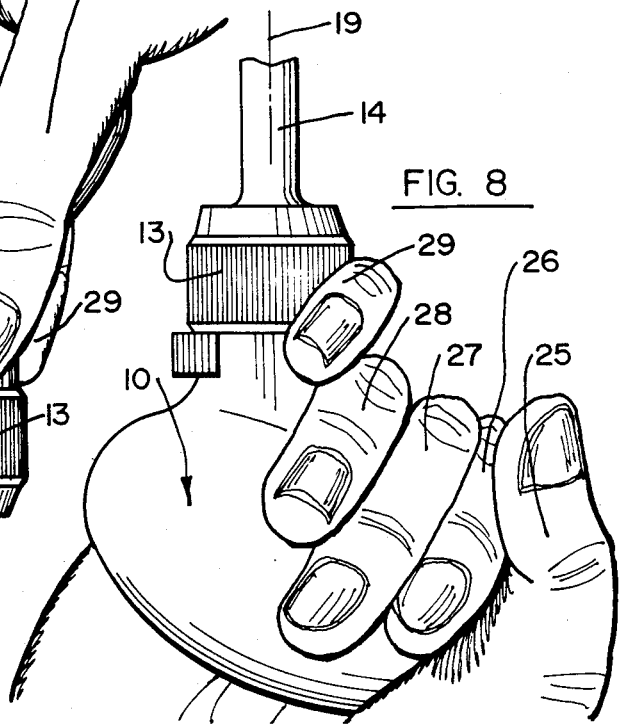
FIG. 8 illustrates a further typical (and alternate) orientation of the operator's hand, the tool in this case being applied overhead.

With reference to FIGS. 6–8, the advantages and utility of the present invention may be more readily appreciated. In FIG. 6, the axis of the tool shank 14 is substantially horizontal as the tool is applied to the work. Whether the operator is right-handed or left-handed is immaterial in so far as the present invention is concerned, but for illustration purposes the hand grip of a right-handed person has been used. In FIG. 6, the operator's thumb 25 and forefinger 26 straddle the handle 10 therebetween, while the lower three fingers 27, 28 and 29 are wrapped around the lower part of the handle which is inclined away from the shank axis 19, such that the handle is comfortably positioned or nested within the palm of the operator's hand. In FIG. 7, the tool is oriented downwardly, and the operator's hand is cupped over the handle 10 with the thumb 25 and fingers 26–29, respectively, extending downwardly. In FIG. 8, the tool is directed vertically for overhead work; the operator's four fingers 26–29 comfortably grip the side of the handle which is inclined away from the shank axis, while the operator's thumb 25 is wrapped over the forefinger.

It will be appreciated that the illustrations in FIG. 6–8 are somewhat schematic and are intended to convey the broad range of hand grips which are possible or feasible with respect to the improved ergonomic handle 10. In each case, the operator may readily "feel" the handle and automatically position a good grip on the handle. The handle will accommodate a variety of hand grips in accordance with the particular work to be performed and the general orientation thereof. This accommodates a preferred wrist action to be employed by the operator for maximum control and leverage consonant with comfort and convenience. As a result, operator fatigue is substantially reduced during extended use of the tool.

Figure 9:
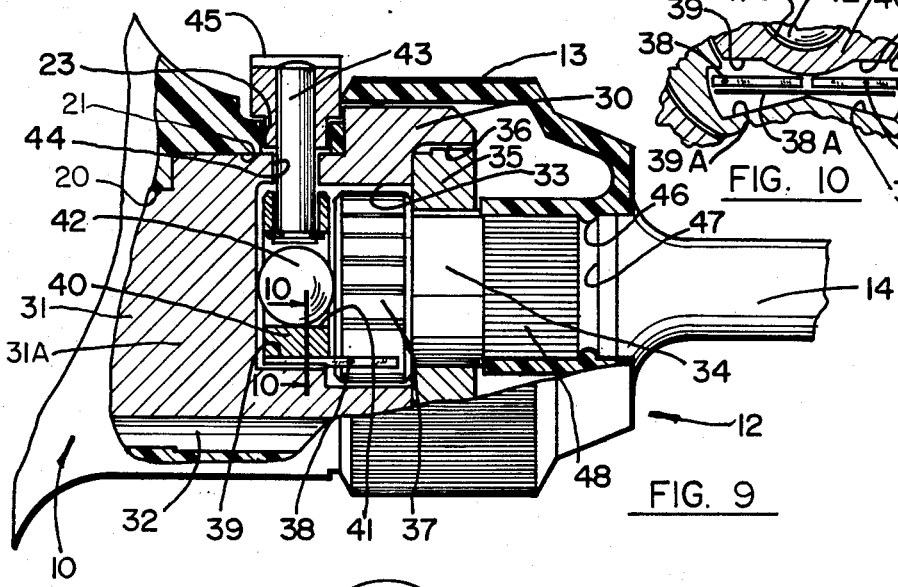
FIG. 9 is a section view, taken along the lines 9—9 of FIG. 1 and drawn to an enlarged scale, showing a preferred ratchet mechanism that may be used with the ergonomic handle of the present invention.
Figure 10:
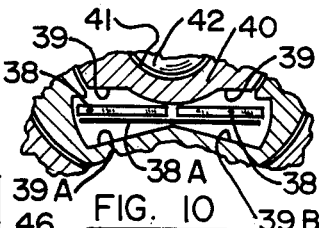
FIG. 10 is a detailed section view, taken along the lines 10—10 of FIG. 9.

With reference to FIGS. 9 and 10, a preferred ratchet mechanism 12 is illustrated for the ratchet wrench 11 of FIG. 1, which, as previously noted, is merely exemplary of a typical hand tool to which the teachings of the present invention may be applied. Preferably, but not necessarily, the ratchet mechanism comprises a ratchet housing 30 having a rearward cylindrical portion 31 press-fitted or otherwise suitably secured to the handle for conjoint turning movement. Preferably, the cylindrical portion 31 is press-fitted within the bore 20 of the handle and has an annular shoulder 31A seated in the counterbore 21 formed in the neck portion 22 of the handle. Moreover, the cylindrical portion 31 has a longitudinal key 32 received in the keyway 24 in the handle. It will be appreciated by those skilled in the art that in lieu of the ratchet housing, a suitable shank means having a complementary formation could be press-fitted within the handle.

With this in mind, the ratchet housing has a blind axial bore 33 within which the rearward portion 34 of the longitudinal shank is telescopically received or nested. A collar 35 is pressed into a counterbore 36 in the ratchet housing to retain the rearward portion of the shank therein. An external ratchet 37 is formed on the rearward portion of the shank. The ratchet alternately cooperates with a pair of L-shaped pawls 38. The pawls 38 are resiliently biased by a flat spring 38A and are alternately engaged by the respective truncated faces 39 of a generally cylindrical cam member 40, as shown in FIG. 10, to push the "undesired" pawl into its respective recess (39A or 39B) formed in the ratchet housing. This determines the clockwise ("forward") or counterclockwise ("reverse") ratchet drive of the ratchet mechanism, which has an intermediate locked position. The cam 40 is seated in the bore 33, between the bottom of the bore and the end of the shank, and is pivotable substantially about the axis of the bore. The cam has a cam bore 41 formed therein, and a thrust ball 42 is seated therein between the bottom of the bore and the end of the shank. The cam ball thus accommodates axial thrust loads on the tool. A selector pin 43 is carried by the cam and projects radially therefrom. The pin 43 passes through an arcuate slot 44 in the ratchet housing and through the communicating arcuate slot 23 in the neck portion 22 of handle 10. A selector button 45 is carried on the end of the pin. The knurled spinner 13 (shown also in FIG. 1) is rotatably piloted on the ratchet housing forwardly of the handle. The spinner has a cylindrical portion provided with an annular bead 46 received in an external annular groove 47 on the shank. The spinner is preferably molded from a suitable plastic material, and the cylindrical portion of the spinner is pressed over the splined portion 48 of the shank. The plastic spinner is softer than the material of the shank, and thus the spinner acquires the configuration of the splines, thereby directly keying the spinner to the shank for rotation in unison. The spinner may be rotated between the operator's thumb and forefinger, optionally at the discretion of the operator, in one of the ratchet drive positions of the mechanism. It will be understood, however, that the specific construction of the ratchet mechanism forms no part of the present invention, being described and claimed in the co-pending application Ser. No. 395,810 filed July 6, 1982 for "Ratcheting Tool" and assigned to the assignee of the present application.

Figure 11:
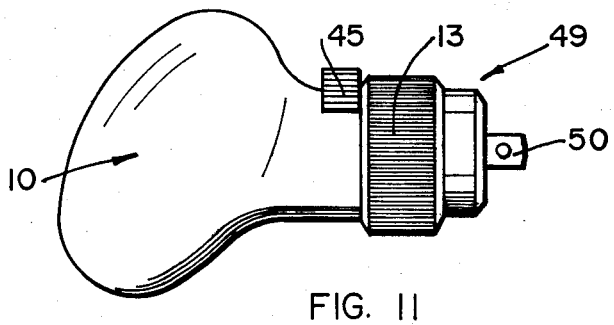
FIG. 11 illustrates another hand tool to which the improved ergonomic handle may be applied, corresponding substantially to the tool shown in FIG. 1, but having a shortened drive stud.
Figure 12:
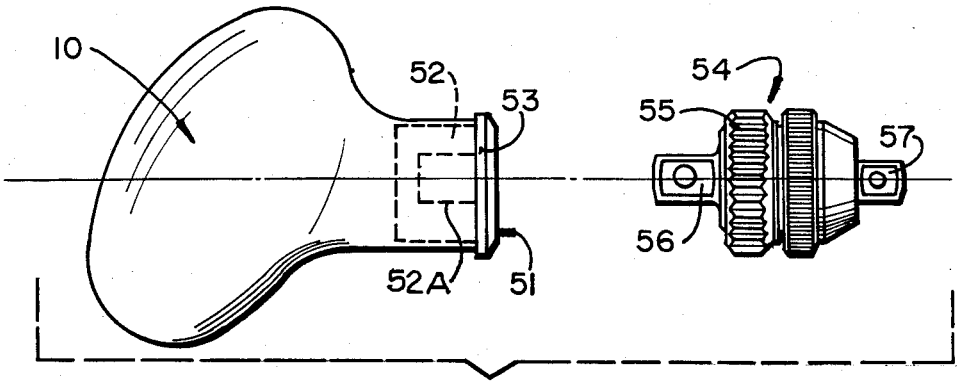
FIG. 12 corresponds substantially to FIG. 11, but shows the improved ergonomic handle having a female socket for connection to the drive stud on a separate ratchet adapter.

With reference to FIGS. 11–12, there are illustrated other examples of hand tools to which the improved ergonomic handle 10 of the present invention may be applied. Thus, in FIG. 11, the handle 10 is applied to a ratchet tool 49 having a shortened drive stud or tang 50. In FIG. 12, the handle 10 has an insert adapter 51 press-fitted or otherwise secured therein; this insert adapter is provided with a body 52 (having a female socket 52A therein) and is further provided with an outer flange 53. The handle cooperates with a suitable ratchet adapter 54. This ratchet adapter 54 has a knurled spinner 55, a male input drive tang 56 (cooperating with the female socket 52A), and an output drive tang 57. The ratchet adapter 54 forms no part of the present invention, being illustrated and described in the aforementioned co-pending application Ser. No. 395,810, filed July 6, 1982, and assigned to the assignee of the present invention.

Thus, it will be appreciated that the improved ergonomic handle of the present invention is equally adjustable to a wide variety of hand tools, devices and implements, especially of the ratchet type.

Obviously, many modifications may be made without departing from the basic spirit of the present invention. Accordingly, it will be appreciated by those skilled in the art that within the scope of the appended claims, the invention may be practiced other than has been specifically described herein.

We claim:

1. In a hand ratchet tool or other implement, the combination of a shank means having a longitudinal axis, an ergonomic handle having a substantially elliptical cross-section provided with a center and a major axis, the longitudinal axis of the shank means substantially passing through the center of the elliptical cross-section and intersecting its major axis, the handle being formed substantially as a surface of revolution of the elliptical cross-section about its major axis, the handle having a forwardly-extending relatively-short integral neck portion provided with a bore and a communicating counterbore therein, and a ratchet mechanism connecting the handle to the shank means, the ratchet mechanism having a ratchet housing including a rearward portion secured within the bore and further including an annular shoulder seated in the counterbore; wherein the ratchet mechanism includes a selector which extends radially through an arcuate slot in the neck portion, is pivotable about the axis of the shank, and is disposed forwardly of, and substantially adjacent to, the handle; and wherein a spinner is carried by the ratchet mechanism forwardly of, and substantially adjacent to, the selector; whereby the selector and spinner are readily accessible to the operator's thumb and forefinger, respectively, for substantial one-hand control of the ratchet tool.

2. The combination of claim 1, further including a longitudinal key formed on the ratchet housing, and the bore in the handle having a longitudinal keyway formed therein to receive the key.

3. The combination of claim 1, wherein the elliptical cross-section of the handle is inclined with respect to the longitudinal axis of the shank and forms an acute dihedral angle with respect to a plane which is normal to the shank axis.

* * * * *